United States Patent [19]

Geis

[11] Patent Number: 4,793,234

[45] Date of Patent: Dec. 27, 1988

[54] CAPO FOR STRINGED INSTRUMENT

[76] Inventor: Karl E. Geis, 1413 Butlercrest, Houston, Tex. 77080

[21] Appl. No.: 167,640

[22] Filed: Mar. 11, 1988

[51] Int. Cl.[4] ..... G10D 3/04

[52] U.S. Cl. ..... 84/318

[58] Field of Search ..... 84/315–319

[56] References Cited

U.S. PATENT DOCUMENTS

| | | | |
|---|---|---|---|
| 1,219,884 | 3/1917 | Thingstad | 84/317 |
| 3,329,055 | 7/1967 | Milliken | 84/318 |
| 4,030,400 | 6/1977 | Del Castillo | 84/317 |
| 4,250,790 | 2/1981 | Shubb et al. | 84/318 |
| 4,270,432 | 6/1981 | Wilkerson | 84/318 |

*Primary Examiner*—Lawrence R. Franklin

[57] ABSTRACT

In the preferred and illustrated embodiment of a capo, such a capo is set forth as comprising a capo for a guitar, banjo or similar stringed instrument including an arm for engaging the instruments' strings; said arm having a contact piece which distributes the pressure on said strings by means of hydraulic pressure, and including a body, for clamping said arm to said strings, which is substantially made of spring like material manufactured in such a shape so as to cause the rear surface of the neck piece of said instrument to function in the manner of a camshaft when the capo is installed, and including a locking mechanism which prevents the accidental disengagement of the capo. The capo is designed so as to allow the installation of the capo to be achieved with one hand, and without requiring the shifting of the instrument from the normal playing position.

6 Claims, 1 Drawing Sheet

CAPO FOR STRINGED INSTRUMENT

BACKGROUND—FIELD OF INVENTION

This invention relates to a capo for use with a stringed musical instrument; such as a banjo or a guitar.

BACKGROUND—DESCRIPTION OF PRIOR ART

References of interest are U.S. Pat. Nos. 7279, 390,612, 402,577, 4,165,670, and 2,985,932. A capo is a device used to affect the tuning of an instrument by shortening the strings from their free length. This is desirable as it allows the person playing the instrument to change musical keys while still playing chords using the same relative fingerings used to play the instrument in the open fretted key. While it would be theoretically possible to tune the instrument each time a key change is required—in practice such tuning is simply too difficult, cumbersome and slow to be used in actual performing situations. In practice previously available capos have performed their function in a less than optimum fashion: it has almost always been necessary to make fine adjustments to the tuning of an instrument once a capo is installed. This invention improves on the existing state of the art in capo design by allowing a capo to be built which may be installed on an instrument without necessitating the tuning of the instrument.

Previous capo designs have recognized—in a somewhat sketchy fashion—that design problems exist in capos as a class: i.e.: the strings on an instrument are not all of the same diameter, and the fingerboard of an instrument may not be a flat surface. Starting with U.S. Pat. No. 390,612 and continuing with all subsequent capo inventions, the inventors have commented on the necessity of using a resilient material between the body of the capo and the instruments' strings. Previous capo designers have failed to grasp the importance of the role played by the material which comes in contact with the strings. The resilient material used in previous capo designs is a crude attempt to solve the contact problems between the capo and the strings of the instrument which occur because of the conditions cited earlier in this paragraph. Resilient materials in general follow the well known Hookes' law of spring constants:

$$f=kx$$

Where 'f' is the force exerted by the compressed material, 'k' is the spring constant of the material, and 'x' is the distance the spring is either stretched or compressed from its free resting position. In previous capo designs the force exerted on the individual strings of the instrument varied from string to string depending upon the degree of compression of the resilient material caused when the capo was tightened on the instrument. Because the pressure on the strings differed from one string to the next it was almost always necessary to tune the instrument once a capo using resilient material to contact the strings was installed. Further, in order to insure that the pressure on all of the strings was sufficient under all circumstances to hold the strings in their shortened positions, it was necessary that the capo be clamped to the instrument with great enough force that the string receiving the least force from the capo received enough force for the capo to perform its function. As a result, far more force had to be used to attach the capo to the instrument than was necessary to hold the strings in their shortened position. In capos of older design it has been a common occurrence for the capo to damage the neckpiece of the instrument

OBJECTS AND ADVANTAGES

It is the purpose of this invention to create a capo which may be installed easily and quickly on an instrument with minimal effort by the musician playing the instrument, which does not require that the musician tune the instrument once the capo is installed, and which is clamped to the instrument with far less force than is necessary when installing a conventional capo, thus reducing the chance that the capo will cause damage to the instrument.

SUMMARY OF THE INVENTION

The invention resides in a stringed instrument capo having a body providing a top or string engaging element adapted to extend transversely across the strings and fingerboard surface of the neck of the instrument with which it is used. An element is attached to the string engaging element which distributes force from the string engaging element to the strings by the means of hydraulic or pneumatic pressure. A side arm made of spring like material extends from the string engaging element to the underside of the fingerboard of the instrument so as to apply a clamping force to both the underside of the neck piece and to the string engaging element. A wheel or roller is attached to the end of the side arm to facilitate installation of the capo and to serve as a locking element for the capo once the capo is installed on the instrument. The side arm of the capo is designed so that the curved back of the fingerboard acts in the fashion of a camshaft in expanding the side arm when the capo is installed on the instrument. The expansion of the side arm by the camshaft action of the fingerboard is responsible for the clamping force exerted by the side arm.

DETAILED DESCRIPTION OF THE PREFERRED EMBODIMENTS

Figure 1:
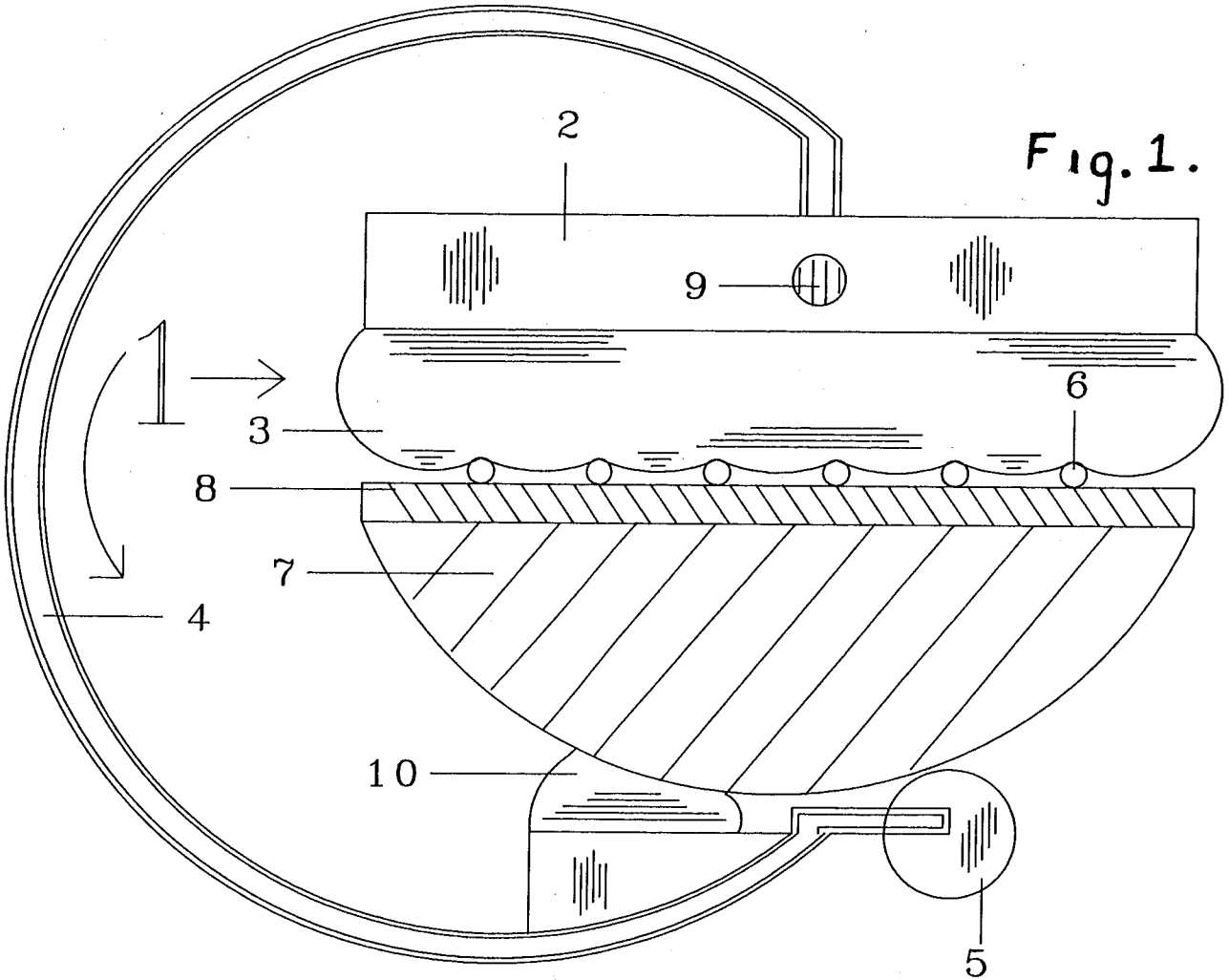
FIG. 1 is a perspective view of the capo embodying this invention.

Referring to FIG. 1 a capo embodying this invention is shown generally at 1. It includes a string engaging arm 2, which is intended to extend across the strings 6 of the instrument 7. It also includes a side arm made of spring like material 4 shaped roughly like a letter 'C'. Also included in the capo is a hydraulic element 3 which applies pressure from string engaging arm 2 to the strings 6, and the fingerboard 8. Also included with the capo is rolling element 5 which serves as both a low friction slider for side arm 4 and as a locking mechanism for 4 when it is engaged by neckpiece 7. In operation elements 2 and 3 are placed on the strings 6 of the instrument. Side arm 4 and rolling element 5 are pivoted about pivot point 9 in a generally counter clockwise direction toward the point on neckpiece 7 directly opposite fingerboard 8. The general cam shape of the rear surface of neckpiece 7 cause side arm 4 to expand—thus causing pressure to be exerted by string engaging arm 2 upon the hydraulic element 3, and thus to strings 6 and fingerboard 8. When rolling element 5 has passed the point of greatest expansion afforded by the cam shape of neckpiece 7 side arm 4 will begin to contract in size until a gas or liquid filled conforming pad 10 contacts neckpiece 7. At this time the installation of the capo on the instrument is complete, and the capo is locked in place by the contact between neckpiece 7, rolling element 5 and conforming pad 10.

CONCLUSION, RAMIFICATIONS AND SCOPE OF THE INVENTION

Thus the reader will see that the capo of the invention provides an easily installed, inexpensive method for applying force to the strings of an instrument such as a guitar, while minimizing any need to tune the instrument after the capo has been installed.

While my above description contains many specificities, these should not be construed as limitations on the scope of the invention, but rather as an exemplification of one preferred embodiment thereof. Many other variations are possible. For example it is obvious that the hydraulic element described above could have multiple chambers, or that the pressure built up in the hydraulic element could be supplied by means of a pump, instead of coming from the spring force of the side arm. Accordingly, the scope of the invention should be determined not by the embodiment illustrated, but by the appended claims and their legal equivalents.

I claim:

1. A capo for a stringed musical instrument having a neck with a front fingerboard surface and a curved rear surface and having a plurality of strings extending longitudinally of said neck over said fingerboard surface, said capo comprising:

a rigid arm adapted to extend transversely across said neck over said strings;

a string contacting member fixed to said arm and adapted to contact and depress said strings; and attaching means for attaching the capo to said neck, said attaching means comprising:

a generally C-shaped, spring-like member pivoted at one end to said arm and adapted to extend around said curved rear surface when attached to said neck in operative position, said spring-like member expanding against its spring bias by the camming action of said curved rear surface of said neck for holding said capo on said neck.

2. The capo as defined in claim 1 further including locking means, said locking means including first and second members fixed in spaced apart relationship on said other end of said spring-like member such that each will be held by said spring bias in contact with said rear curved surface of said neck on opposite sides of the thickest portion of said neck.

3. The capo as defined in claim 2 wherein said first member is a roller element for assisting in the installation of said capo on said neck and said second member is a soft, neck-surface conforming pad.

4. The capo as defined in claim 1 wherein said string contacting member is a hydraulic element.

5. The capo as defined in claim 4 wherein said hydraulic element is a gas filled pad.

6. The capo as defined in claim 4 wherein said hydraulic element is a fluid filled pad.

* * * * *